US005505336A

United States Patent [19]

Montgomery et al.

[11] Patent Number: 5,505,336

[45] Date of Patent: Apr. 9, 1996

[54] ICE CREAM DISPENSER

[75] Inventors: Michael W. Montgomery, Beverly Hills; Charles H. Blair, Bloomfield Hills, both of Mich.

[73] Assignee: The Diggs Group, Dayton, Ohio

[21] Appl. No.: 196,015

[22] Filed: Feb. 14, 1994

[51] Int. Cl.[6] ..... B67D 5/00

[52] U.S. Cl. ..... 222/82; 222/83; 222/95; 222/326; 222/387

[58] Field of Search ..... 222/82, 83, 83.5, 222/61, 63, 52, 95, 105, 146.6, 162, 326, 333, 386, 387, 388, 390, 396; 141/330

[56] References Cited

U.S. PATENT DOCUMENTS

| | | | |
|---|---|---|---|
| 1,677,603 | 7/1928 | Steen | 222/95 |
| 1,880,354 | 10/1932 | Mueller | 222/95 |
| 1,944,201 | 1/1934 | Wharton | 222/95 |
| 1,965,271 | 7/1934 | Wharton | 222/95 |
| 2,309,605 | 1/1943 | Lee | 222/107 |
| 2,318,928 | 5/1943 | Deighton | 222/95 |
| 2,432,025 | 12/1947 | Lorenz | 222/95 |
| 2,558,887 | 7/1951 | Tesiero | 222/146.6 |
| 2,559,840 | 7/1951 | Arthur | 222/61 |
| 3,104,031 | 9/1963 | Wagner | 222/80 |
| 3,223,289 | 12/1965 | Bouet | 222/209 |
| 3,847,304 | 11/1974 | Cohen | 222/105 |
| 3,860,147 | 1/1975 | Vessio et al. | 222/96 |
| 3,951,310 | 4/1976 | Steiman | 222/95 |
| 4,077,543 | 3/1978 | Kulikowski et al. | 222/95 |
| 4,077,544 | 3/1978 | Malacheski et al. | 222/95 |
| 4,136,802 | 1/1979 | Mascia et al. | 222/95 |
| 4,155,304 | 5/1979 | Schweisser et al. | 222/95 |
| 4,213,545 | 7/1980 | Thompson et al. | 222/386.5 |
| 4,296,786 | 10/1981 | Brignola | 222/83.5 |
| 4,515,293 | 5/1985 | Hill et al. | 222/95 |
| 4,577,783 | 3/1986 | Racca et al. | 222/386.5 |
| 4,756,450 | 7/1988 | Negaty-Hindi et al. | 222/95 |
| 4,775,564 | 10/1988 | Shriver et al. | 222/95 |
| 4,856,567 | 8/1989 | Cosmai | 141/330 |
| 5,048,724 | 9/1991 | Thomas | 222/95 |
| 5,050,775 | 9/1991 | Marquardt | 222/105 |
| 5,060,826 | 10/1991 | Coleman | 222/95 |
| 5,069,364 | 12/1991 | McGill | 222/95 |
| 5,199,278 | 4/1993 | Cocchi | 62/343 |
| 5,232,027 | 8/1993 | Karasawa et al. | 222/95 |

FOREIGN PATENT DOCUMENTS

| | | |
|---|---|---|
| 0314209A2 | 5/1989 | European Pat. Off. . |
| 1291751 | 11/1989 | Japan . |
| 2213532 | 8/1989 | United Kingdom . |
| 2230057 | 10/1990 | United Kingdom . |
| 2234556 | 2/1991 | United Kingdom . |

*Primary Examiner*—Andres Kashnikow
*Assistant Examiner*—Philippe Derakshani
*Attorney, Agent, or Firm*—Harness, Dickey & Pierce

[57] ABSTRACT

A dispenser for dispensing a frozen product utilizes a collapsible container which is prefilled with the product. The container is removably inserted within a housing defining a thermally insulated chamber and having a refrigeration system for cooling the chamber, and a pointed tubular member adapted to puncture the container when it is disposed in the chamber. To dispense the product, a powered member pushes upon the container toward the pointed tubular member to force the frozen product out through the opening and through the tubular member. A shut-off valve is coupled with the tubular member for selectively preventing the frozen product from being dispensed.

4 Claims, 3 Drawing Sheets

ICE CREAM DISPENSER

BACKGROUND AND SUMMARY OF THE INVENTION

The present invention relates generally to dispensing apparatus, and more particularly to frozen product dispensers incorporating a prefilled, removable container.

Ice cream is often dispensed in retail ice cream stores from individual pre-packaged cardboard containers. The ice cream is scooped out by hand and individually served to the consumer. Scooping the ice cream by hand allows a retailer to serve hard ice cream which is generally considered to taste better than other types, and enables the ice cream to incorporate a variety of hard flavor particles, such as chocolate, nuts, or pieces of fruit, etc. An advantage of the hand scoop method is that a wide range of flavors can be sold at a single outlet. No complicated dispensing apparatus is required, and hand-scooped ice cream is relatively cheap to produce and transport. However, scooping the ice cream by hand is work intensive, expensive, and requires a relatively large display freezer for holding a variety of flavors. Moreover, hand scooping is slow, especially because hygiene precautions require that each scoop be washed after each serving.

Another method for dispensing frozen food products utilizes "soft-serve" dispensing apparatus in which the ingredients of the products are loaded into the device in liquid form. The soft-serve dispenser then mixes, freezes, and subsequently dispenses the frozen product, such as soft-serve ice cream or yogurt, into edible cones or other containers. These types of dispensers are complicated, and are often difficult and expensive to maintain. Sanitary considerations require extensive cleaning efforts after each batch of product is dispensed to clean the interior and moving elements of the dispensers. In addition, such dispensers are incapable of dispensing a "hard frozen" product, such as may be provided by the hand scooped method. Rather, dispensing apparatus have generally been only capable of dispensing "soft-serve" products, which are generally of inferior quality in texture and taste when compared with scoop dispensed products. Moreover, soft-serve dispensing apparatus are incapable of dispensing frozen products which include hard flavor particles because the particles clog the dispenser. Soft-serve dispensers have generally required great amounts of power to operate and have been expensive to manufacture. Furthermore, each different flavor or product generally requires different mixing and dispensing methods or equipment, so each dispenser may only be used for a particular narrow range of flavors and types of products.

Accordingly, it is an object of the present invention to provide dispensing apparatus which overcomes the problems of the prior art, including those described above.

It is an additional object of the present invention to provide dispensing apparatus capable of dispensing hard frozen food product, including hard flavor particles.

Additional advantages and features of the present invention will become apparent from the subsequent description and the appended claims, taken in conjunction with the accompanying drawings.

DETAILED DESCRIPTION OF THE PREFERRED EMBODIMENTS

The following description of the preferred embodiments is merely exemplary in nature, and is in no way intended to limit the invention, or its application or uses.

Figure 1:
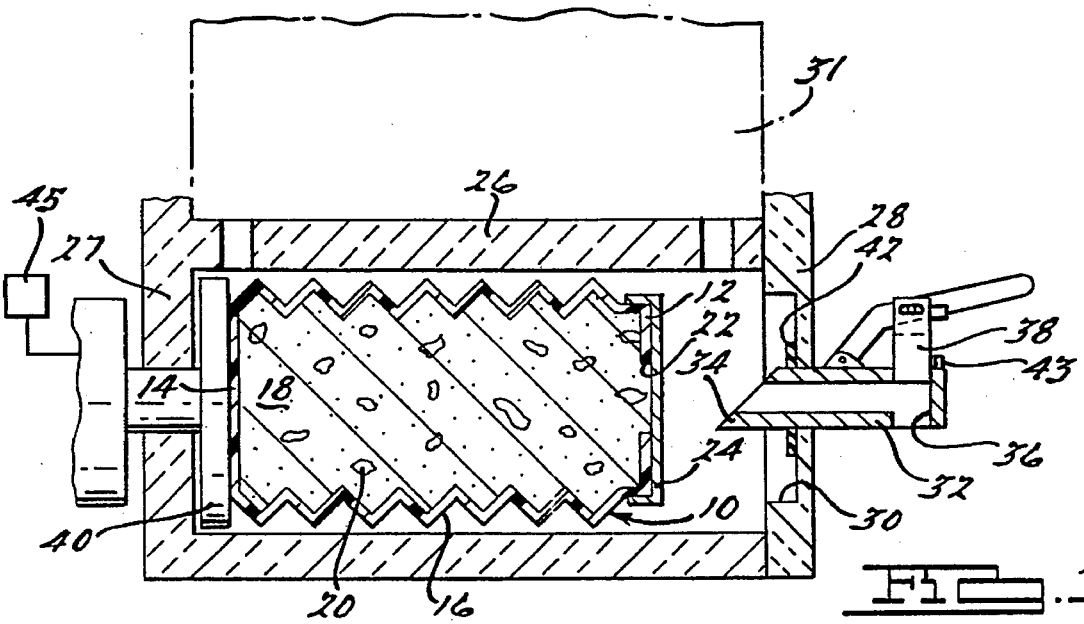
FIG. 1 is a cross-sectional diagrammatic view of an initially loaded dispenser according to the present invention.
Figure 2:
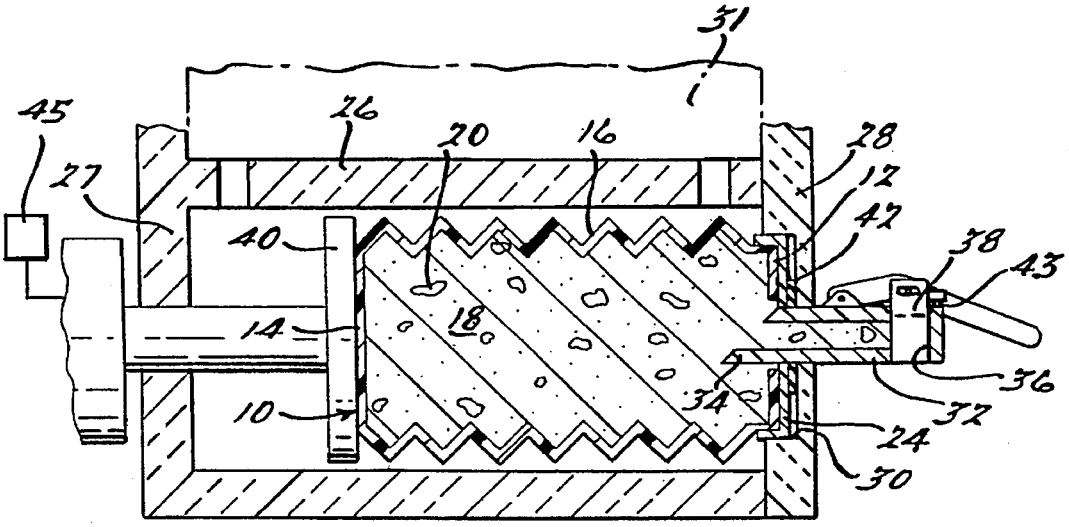
FIG. 2 is a cross-sectional diagrammatic view of the dispenser of FIG. 1 after initial actuation.

Referring now to FIGS. 1 and 2, a novel dispenser is shown for dispensing a frozen food product, incorporating a frozen product container 10 which has a front end wall 12, a rear end wall 14, and a collapsible side wall 16 which preferably has flexible corrugations for allowing a length of side wall 16 to be changed. Side wall 16 preferably has a generally circular cross-section, but may also have a rectangular or triangular cross-section. Container 10 is prefilled with frozen product 18 by a manufacturer before being shipped to various retail stores. Frozen food product 18 is preferably hard frozen ice cream, which may include a variety of one or more types of hard flavor particles 20, such as nuts, pieces of fruit, or chocolate. The retailers thus need not purchase and maintain complicated mixing, freezing, and other manufacturing equipment, while the manufacturer can ensure that the frozen food product 18 is of high quality and can provide a wide variety of flavors.

Side wall 16 is adapted to expand and contract in length, allowing end walls 12 and 14 to move longitudinally relative to each other. The interior volume of container 10 may thus be changed, either expanded or contracted. Front end wall 12 is formed with an opening 22 for filling the container and for allowing frozen product 18 to flow from container 10. Except for opening 22, container 10 is imperforate. Container 10 is preferably made of flexible plastic, but may be constructed of various other materials, including paper products such as heavy cardboard, and polymeric single ply or laminate sheet, or the like. In addition, container 10 should preferably be filled through opening 22 with product 18 under pressure while side wall 16 is in an initially collapsed state, so as to create a minimum of air bubbles in the recesses of corrugated side wall 16, and to more thoroughly fill container 10 with product 18.

A cap 24 is affixed to front end wall 12 of container 10, forming a diaphragm extending across opening 22 for preventing frozen product 18 from flowing through opening 22 and escaping from container 10 before normal dispensing of product 18. Cap 24 thus seals container 10 after it is filled with product 18 and while it is transported to the retailer, before being installed in the dispenser of the present invention. Cap 24 is preferably formed of a relatively thin frangible plastic or metal foil, but may also be made of a paper product, such as cardboard. Moreover, cap 24 may be affixed to container 10 by any of a variety of methods, including an adhesive, a crimp seal, or a peripheral clamp.

The dispenser of the present invention comprises a rigid enclosed housing 26 defining a chamber and having an integral rear wall 27 and a removable front wall or retaining wall 28 with a cylindrical cavity 30. The walls of housing 26 preferably are relatively thick and have thermal insulation to reduce heat transfer losses. Front wall 28 can be mounted to be opened and closed or to be completely removed and reattached, and it is locked in place in a closed position by any known suitable method of attachment (not shown). Container 10 may thus be inserted within housing 26 for dispensing operation, and can then be easily removed and replaced when it is substantially empty. The dispenser also has the usual refrigeration equipment 31 for cooling container 10 and product 18, to maintain product 18 in a suitably hard frozen state.

Dispensing means includes a tubular member 32 which is affixed to front wall 28, and thereby to housing 26, in a generally longitudinal orientation. Tubular member 32 has a pointed inlet end 34 and an outlet or dispensing opening 36. A shut-off valve 38 is affixed to tubular member 32 near outlet 36. Valve 38 is shown in FIG. 1 in an opened position, and it is operative to be manually closed (as shown in FIG. 2) to prevent product 18 from flowing through outlet 36. Valve 38 may be any desired type known in the art.

The dispenser of the present invention also has a powered member 40 or other pressing device, such as a piston, hydraulic ram, or electric actuator. Piston 40 is operative for pressing forward on rear end wall 14 toward tubular member 32 to cause container 10 to move from the loading position shown in FIG. 1 to the operating position shown in FIG. 2. Upon actuation, piston 40 presses container 10 in the direction of tubular member 32 so that pointed inlet end 34 punctures cap 24, forming a passage therethrough. Tubular member 32 passes through opening 22 formed in front end wall 12, and further extends into a portion of frozen product 18. The inner dimensions of housing 26 should be such that container 10 is closely surrounded, so that housing 26 can restrict lateral expansion of side wall 16 under pressure from piston 40. An annular gasket 42 is preferably provided, surrounding tubular member 32 and disposed between cap 24 and retaining wall 28, for preventing product 18 from leaking around tubular member 32. In the operating position shown in FIG. 2, front end wall 12 and cap 24 cooperate with and are held in alignment by cavity 30 so that tubular member 32 is aligned with opening 22. Further actuation of piston 40 will progressively reduce the volume of container 10, so that frozen product 18 is forced out of container 10 and is caused to flow into and through tubular member 32.

Valve 38 is normally closed when the dispenser is not in use. When it is desired to dispense product 18, valve 38 is manually opened, thereby closing a switch 43. This activates piston 40 to longitudinally push rear end wall 14 toward front walls 12 and 28. Retaining wall 28 concurrently imposes an opposing force against front end wall 12. The interior volume of container 10 is compressed. Product 18 is then forced from container 10 through opening 22, and is dispensed through tubular member 32 and outlet 36. When valve 38 is then closed, switch 43 is opened, thereby deactivating piston 40 and causing it to exert no compressive force against rear end wall 14. Valve 38 then prevents dispensing of product 18.

Tubular member 32 should preferably be sized so as to fit snugly within opening 22 to reduce the possibility of leakage 15 product 18. Opening 22 and tubular member 32 should also have sufficient corresponding diameters so that product 18 may be forced therethrough by piston 40 without requiring excessive pressure. This relatively large inner dimension of tubular member 32 allows the dispenser to more easily dispense hard frozen ice cream, even including various discrete flavor particles 20.

It should be noted that the overall length of tubular member 32 should preferably be as short as possible to reduce heat transfer losses with ambient air. Also, the internally disposed pointed inlet end 34 of tubular member 32 should be as short as possible while still capable of puncturing diaphragm 24, because its extension within container 10 will prevent piston 40 from fully collapsing container 10, which can result in a small amount of product loss. In addition, inlet end 34 of tubular member 32 and opening 22 should be shaped to avoid cutting and separating a disc in the diaphragm defined by cap 24, which might then be free to travel down tubular member 32 and be dispensed with product 18.

An overpressure feedback device 45 is provided for automatically deactivating piston 40 when the compressive force required to move piston 40 surpasses a preselected limit amount. Preferably the piston should be moved or be allowed to move a slight distance in the retracting direction to relieve the pressure on product 18 and reduce the possibility of product leakage. Feedback device 45 also tends to prevent damage to the dispenser in the event that switch 43 fails. A less sophisticated pressure relieving system would involve constructing piston 40 such that it either presses inward, or is deactivated and is allowed to retract in response to pressure in said container. This type of simple pressure relieving mechanism could not relieve excessive pressure while piston 40 is pressing inward to dispense product 18, for example if tubular member 32 is blocked, but would relieve excess pressure under normal operation, when shut-off valve 38 is closed and switch 43 is opened.

Figure 3:
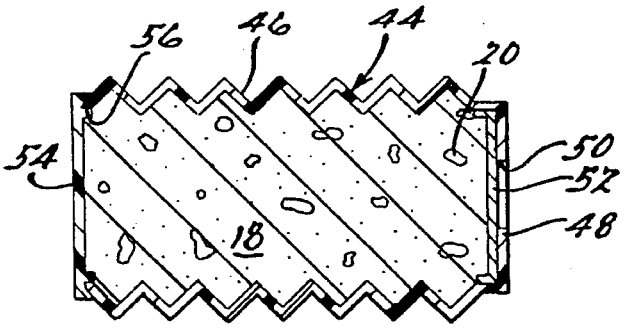
FIG. 3 is a cross-sectional view of a container according to an alternative embodiment of the present invention.

FIG. 3 depicts an alternative embodiment of the present invention and shows a frozen product container 44 having a flexible, corrugated side wall 46 similar to side wall 16 of container 10. Again, side wall 46 may be formed having various elongated cross-sectional shapes, such as a circle or rectangle. Container 44 is formed with a front end wall 48 which is preferably formed integrally with corrugated side wall 46 and has an opening 50 for allowing frozen product 18 to escape from container 44. In addition, a frangible inner cap or inner end lining 52 is provided adjacent to an inner surface of front end wall 48, forming a diaphragm extending across opening 50 for initially preventing frozen product 18 from passing therethrough. Container 44 is further provided with a rear end cap 54 which is affixed to the rear of side wall 46. Container 44 is constructed and filled by first integrally forming side wall 46 and front end wall 48 incorporating opening 50. Inner end lining 52 is placed inside container 44 abutting an interior surface of front end wall 48. Side wall 46 is preferably initially collapsed before frozen product 18 is pumped into container 44 through a rear opening 56 defined by the rear perimeter of side wall 46. The embodiment shown in FIG. 3 thus allows frozen product 18 to be pumped into container 44 through a much larger aperture, requiring less pressure for filling. After container 44 is filled with frozen product 18, rear end cap 54 is affixed to side wall 46, sealing rear opening 56. Container 44 is then transported from the manufacturer to the retailer. At the retail store, container 44 is then inserted within housing 26 and pressed into place by piston 40 with the periphery of front end wall 46 being accepted within cavity 30, and with pointed inlet end 34 of tubular member 32 puncturing inner end lining 52.

Frozen product 18 is thereby allowed to flow through tubular member 32 and is dispensed through outlet 36, in the same manner as in the previous embodiment.

Figure 4:
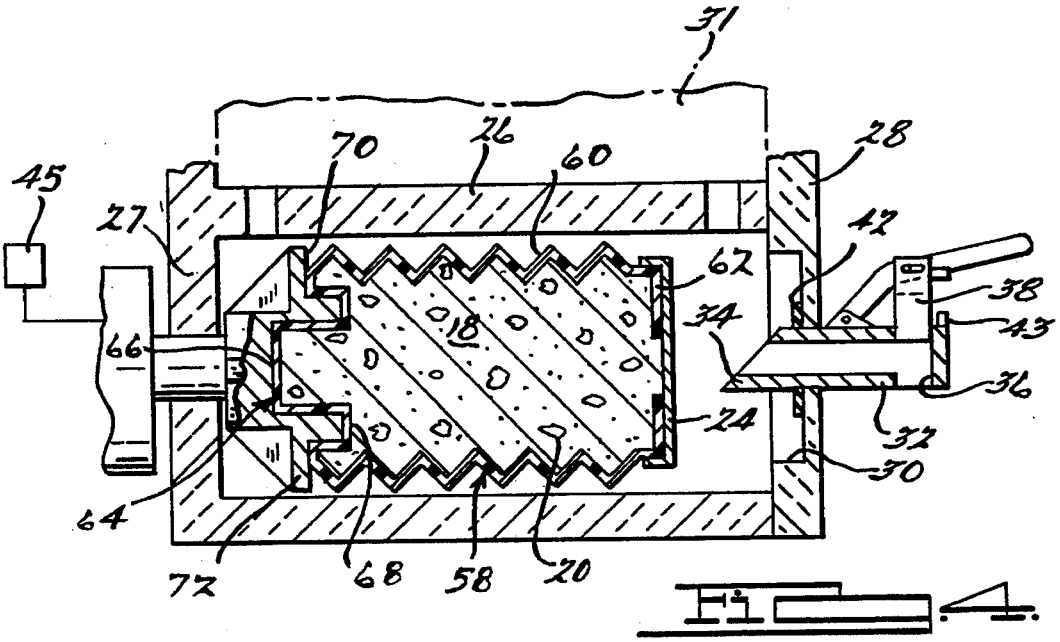
FIG. 4 is a cross-sectional diagrammatic view according to another alternative embodiment of the present invention.
Figure 5:
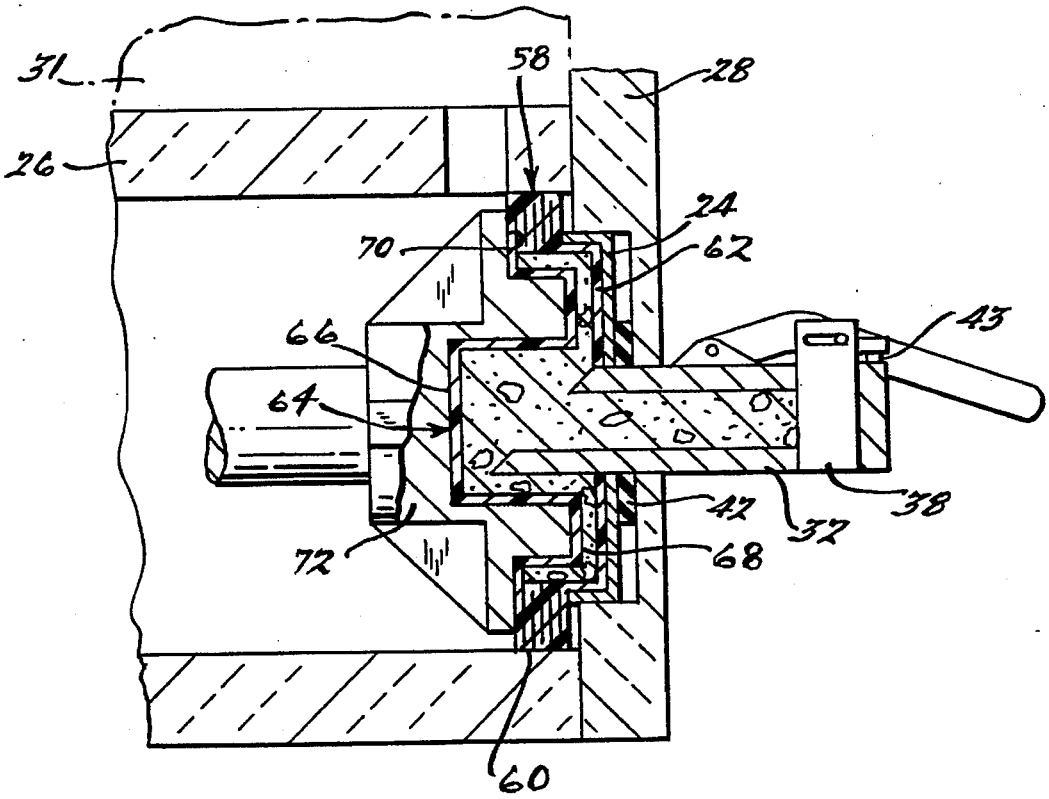
FIG. 5 is a partial cross-sectional view of the dispenser of FIG. 4 after dispensing product.

If desired, in order to reduce product loss, a container 58 which has a side wall 60 and a front end wall 62 similar to those of container 10, can be formed with a modified rear end wall 64 having a central recess 66 which is complementary in shape to, and capable of receiving, pointed end 34 of tubular member 32. Rear end wall 64 thus enables a greater portion of product 18 to be dispensed. Recess 66 may have a cylindrical shape as shown in FIG. 4, or may be formed in an angularly truncated shape to more closely match the shape of pointed end 34. To further reduce product loss by displacing a greater volume of container 58, rear end wall 64 may be provided with an annular indented ring 68 surrounding recess 66. Of course, a modified rear end wall 64 might be formed separately and then be affixed to side wall 60 of container 58. Accordingly, a pressing surface 70 of piston 72 preferably has a complementary shape to accommodate and mate with the modified shape of rear end wall 64, including conforming to recess 66 and ring 68, as shown in FIGS. 4 and 5.

Figure 6:
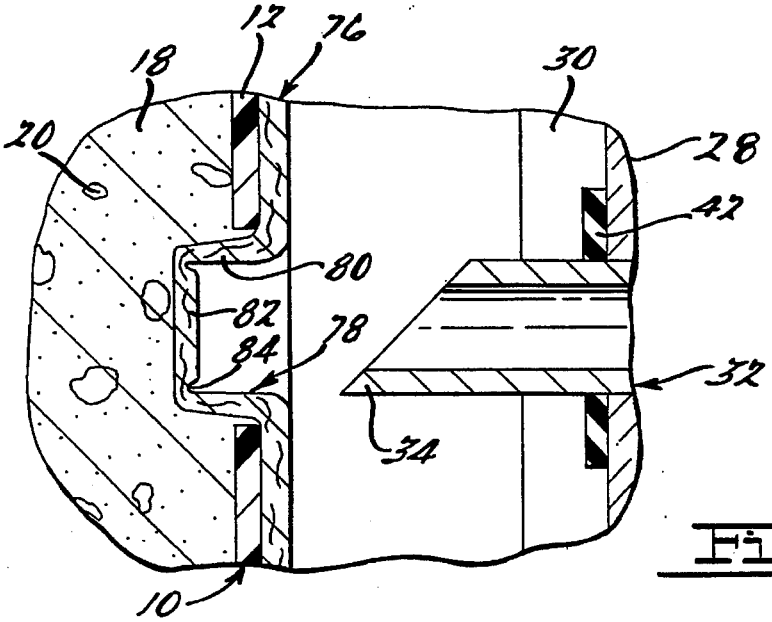
FIG. 6 is a partial cross-sectional view of an initially loaded dispenser according to an additional alternative embodiment of the present invention.
Figure 7:
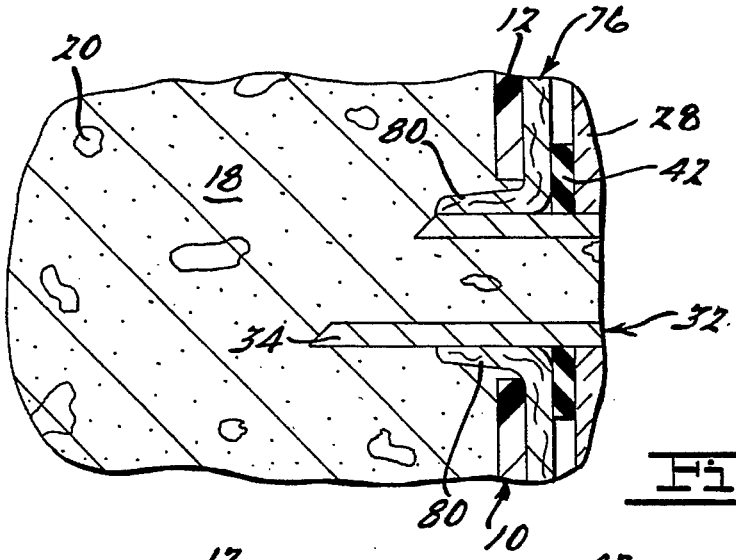
FIG. 7 is a partial cross-sectional view of the dispenser of FIG. 6 after initial actuation.

FIGS. 6 and 7 depict optional refinements of the present invention, in which container 10 holding product 18 is provided with a modified cap or diaphragm 76 having an indented well 78 formed by an annular side wall 80 and a disc or plug 82. Modified cap 76 is a unitary molding which preferably incorporates a weakened section or reduced thickness web 84, which couples disc 82 to an inner end of annular side wall 80. Pointed inlet end 34 will thus puncture web 84 when container 10 is forced into place. In contrast to the embodiments described above, plug 82 will completely break away from cap 76 and will pass through tubular member 32 as product 18 is initially dispensed. Plug 82 may then be discarded before frozen food product 18 is dispensed to customers. After pointed end 34 punctures diaphragm 76, annular side wall 80 surrounds tubular member 32 and acts as a lip seal to prevent leakage of product 18, as shown in FIG. 7.

Figure 8:
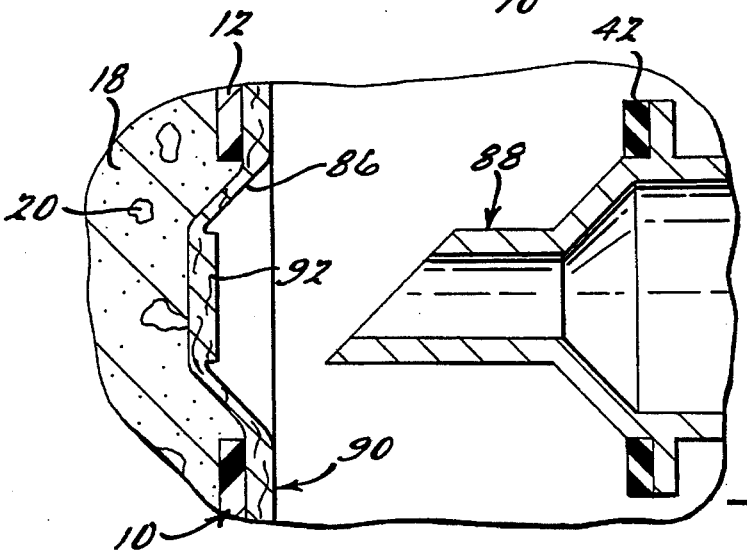
FIG. 8 is a partial cross-sectional view of yet another alternative embodiment of the present invention.

FIG. 8 shows an embodiment similar to that of FIGS. 6 and 7, wherein a further modified cap 90 incorporates a side wall 86 and a plug 92. Side wall 86 and pointed inlet end 88 are formed with corresponding frusto-conical shapes which are designed to mate for enhanced sealing.

The present invention thus provides unique dispensing apparatus capable of dispensing a hard frozen product, even one incorporating hard flavor particles, such as pieces of fruit, nuts, or chocolate. The present invention provides a prefilled, removable, dispensable container which is inserted within the dispenser which is relatively simple, sanitary, and easy to clean.

It should be understood that an unlimited number of configurations of the present invention can be realized. The foregoing discussion discloses and describes merely exemplary embodiments of the present invention. One skilled in the art will readily recognize from the discussion and from the accompanying drawings and claims that various changes and modifications can be made without departing from the spirit and scope of the invention, as defined in the following claims.

We claim:

1. A container for a product to be dispensed and adapted to be removably inserted within a dispenser having a collapsible housing chamber incorporating a pointed tubular member, comprising:

a first and second end wall, said first end wall having an opening for allowing said product to flow therethrough, a portion of said second end wall of said container having a recess for receiving an inner end of said pointed tubular member after a substantial portion of said product has been dispensed, so as to enable a greater portion of said product to be dispensed from said container;

a side wall having a collapsible length and extending between said first and second end walls, thus permitting said end walls to move relative to each other in a longitudinal direction, said container being imperforate except for said opening; and a frangible diaphragm affixed to said first end wall and extending across said opening to prevent said product from flowing therethrough prior to normal dispensing, said diaphragm adapted to be punctured by said pointed tubular member when said container is disposed in said housing chamber and the chamber is collapsed such that said product will flow from said container into said pointed tubular member, from which it can be dispensed.

2. The container as set forth in claim 1, wherein a portion of said second end wall of said container has an annular indentation surrounding said recess for displacing a greater portion of said product from said container.

3. A dispenser for dispensing a frozen product, comprising:

a container prefilled with said frozen product and having first and second end walls, and a collapsible side wall extending therebetween for permitting said end walls to move relative to each other in a longitudinal direction, said first end wall having an opening for allowing said frozen product to flow therethrough;

a diaphragm affixed to said first end wall and extending across said opening to prevent said product from flowing therethrough prior to normal dispensing;

a housing defining a thermally insulated chamber for removably holding said container;

a pointed tubular member affixed to said housing adapted to puncture said diaphragm and project into said opening, whereby said frozen product may flow from said container through said tubular member;

a powered member for imposing a compressive force against said second end wall of said container toward said pointed tubular member to cause said pointed tubular member to puncture said diaphragm and to reduce the volume of said container, so that said frozen product is forced out of said container and is caused to flow into and through said pointed tubular member; and a shut-off valve connected with said pointed tubular member for selectively preventing said frozen product from flowing through said pointed tubular member.

4. A method of dispensing a frozen product from a dispenser having a chamber, comprising:

removably inserting a container prefilled with said frozen product within said chamber;

maintaining said frozen product in frozen condition;

piercing said container with a pointed tubular member having a shut-off valve connected with said pointed tubular member;

selectively reducing the volume of said container to force said frozen product out of said container through said pointed tubular member; and dispensing said frozen product from said pointed tubular member.

* * * * *

UNITED STATES PATENT AND TRADEMARK OFFICE

CERTIFICATE OF CORRECTION

PATENT NO. : 5,505,336

DATED : April 9, 1996

INVENTOR(S) : Michael W. Montgomery; Charles H. Blair

It is certified that error appears in the above-indentified patent and that said Letters Patent is hereby corrected as shown below:

Column 3, line 67, "15" should be — of —.

Signed and Sealed this

Thirteenth Day of August, 1996

*Attest:*

Bruce Lehman

BRUCE LEHMAN

*Attesting Officer*

*Commissioner of Patents and Trademarks*